United States Patent [19]

Mele

[11] 4,280,642

[45] Jul. 28, 1981

[54] APPARATUS FOR MAKING A BOW

[76] Inventor: Cam Mele, 12120 Rte. 30, North Huntingdon, Pa. 15642

[21] Appl. No.: 100,950

[22] Filed: Dec. 6, 1979

[51] Int. Cl.[3] ..... A41H 43/00

[52] U.S. Cl. ..... 223/46; 428/4

[58] Field of Search ..... 223/46; 28/147, 150; 428/4

[56] References Cited

U.S. PATENT DOCUMENTS

| | | | |
|---|---|---|---|
| 2,521,863 | 9/1950 | Mertz | 223/46 |
| 2,542,222 | 2/1951 | Welch | 223/46 |
| 2,569,943 | 10/1951 | Mitchell | 223/46 |
| 2,666,249 | 1/1954 | Ruiz et al. | 28/150 |
| 2,763,080 | 9/1956 | Welch | 223/46 X |
| 3,428,227 | 2/1969 | Cavoli | 223/46 |
| 3,462,049 | 8/1969 | Smith | 223/46 |
| 3,501,071 | 3/1970 | Zadosko | 223/46 |
| 3,754,692 | 8/1973 | Sanders | 223/46 |

*Primary Examiner*—Louis Rimrodt

*Attorney, Agent, or Firm*—Reed, Smith, Shaw & McClay

[57] ABSTRACT

The present invention relates to a decorative product comprising in a single unit a bow and an elastomeric fastener attached to the bow by connective means and to an apparatus for its production.

8 Claims, 7 Drawing Figures

APPARATUS FOR MAKING A BOW

FIELD OF THE INVENTION

The present invention relates to a decorative product, and more particularly to a decorative product to embellish packages and boxes and an apparatus for its production.

BACKGROUND OF THE INVENTION

Decorative products have been used in the past to embellish packages and boxes containing gifts. Such decorative products include paper wrappings, ribbons, bows, appliques, decorative cords and miniature toys. Generally, these decorative products are used individually; i.e., a gift box is either decorated with a decorative cord or embellished with a bow or ribbons. Sometimes, more than one decorative product is used with a gift box or package, but in such instances these products are individually attached to the box or package. Until the advent of the present invention, no such decorative product was available or used which combined into a single decorative unit both a bow and an elastic cord for use with gift boxes and packages.

SUMMARY OF THE INVENTION

The present invention pertains to a decorative product comprising in a single unit a bow and an elastomeric fastener attached to the bow by connective means and to an apparatus for its production. In a most preferred embodiment, the elastomeric fastener is an elastomeric cord which forms a continuous, closed loop having an ornamental, metallic overlay and which is connected to the bow by knotting the fastener around the bow.

DETAILED DESCRIPTION OF THE INVENTION

Figure 1:
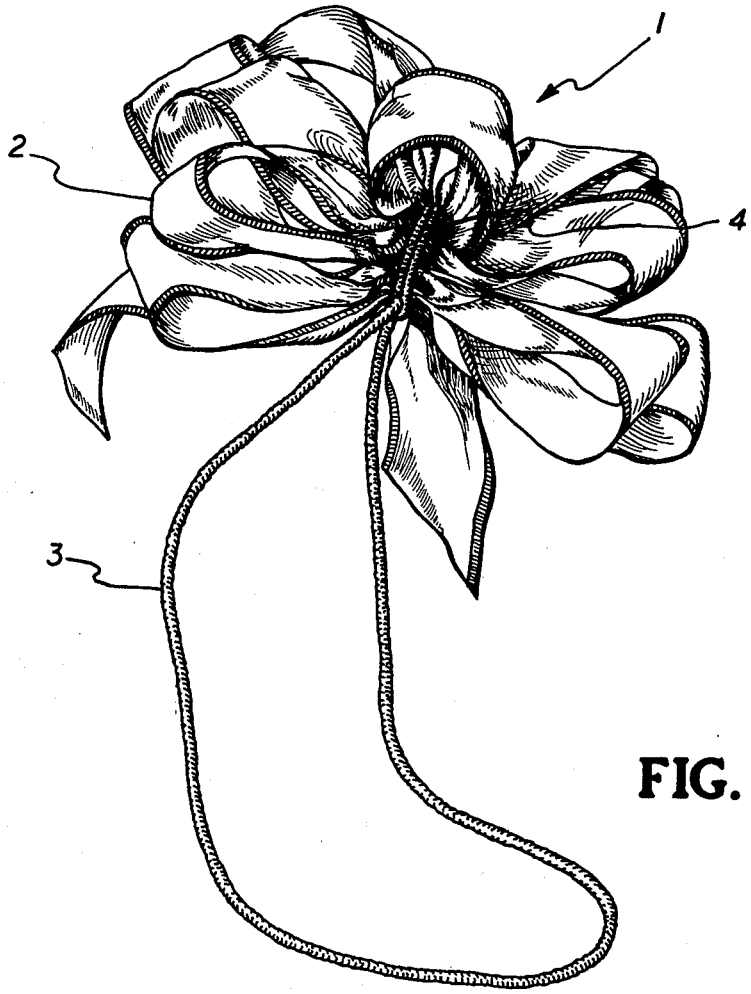
FIG. 1 is a top view of a decorative product according to the invention illustrating a bow and an elastomeric fastener attached to the bow by a knot in the elastomeric fastener which extends around the bow.

Referring to FIG. 1, the decorative product 1 of the present invention comprises a bow 2 and an elastomeric fastener 3 attached to the bow by connective means 4.

As used herein, a bow is understood to mean any looped, knotted or shaped gathering of ribbon, cloth, paper or other flexible material which is suitable as a decoration on a box or package, and an elastomeric fastener is understood to mean any device for holding together two objects or parts sometimes required to be separate, such as a top and bottom of a box or container or two edges of flaps of a box or container, wherein the device is formed from a substance having the properties of natural, reclaimed or synthetic rubber; i.e., stretches under tension, has a high tensile strength and retracts rapidly.

The bow of the decorative product of the invention may be formed from any flexible material. Preferred flexible materials include woven and non-woven fabrics, cloth ribbons and paper ribbons. Particularly preferred flexible materials are cloth ribbons.

The elastomeric fastener of the novel decorative product may include any device which meets the definition of this component of the invention as defined hereinabove. Preferred elastomeric fasteners include an elastomeric cord or band which in a more preferred embodiment forms a continuous, closed loop. In its most preferred embodiment, the elastomeric fastener is an elastic cord which forms a continuous, closed loop having an ornamental, metallic overlay.

Any suitable connective means may be used to attach the bow to the elastomeric fastener. Preferred connective means include a knot in the elastomeric fastener which extends around the bow, a staple which attaches the elastomeric fastener to the bow and an adhesive, such as glue, which adheres the elastomeric fastener to the bow. In the most preferred embodiment, the connective means is a knot in the elastomeric fastener which extends around the bow.

Figure 2:
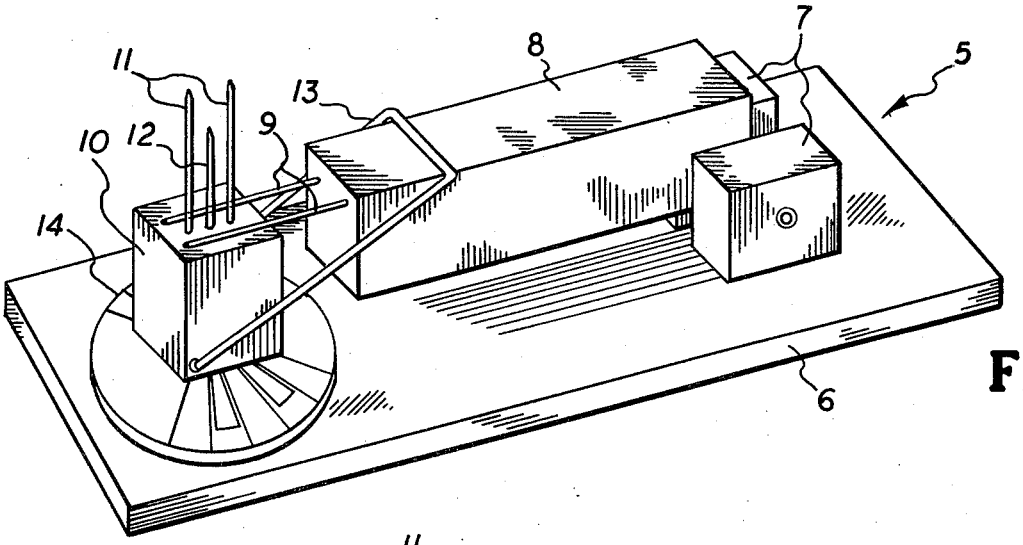
FIG. 2 is an elevated side view of an apparatus according to the invention for the production of the novel decorative product according to the invention.
Figure 3:
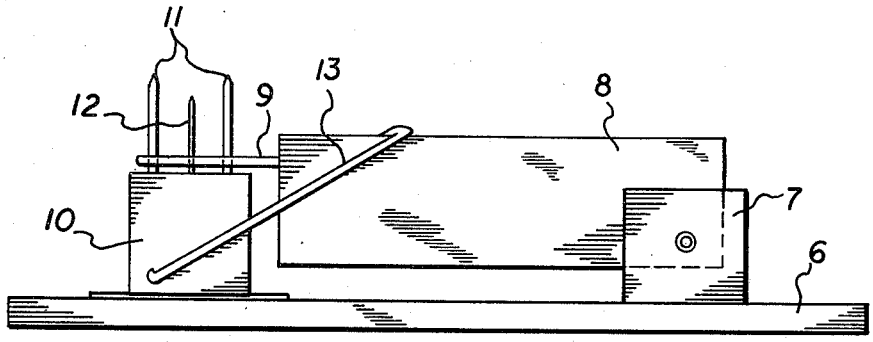
FIG. 3 is a side view of the apparatus of FIG. 2.
Figure 4:
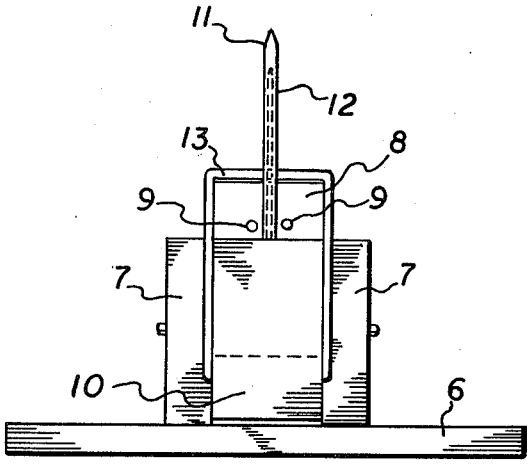
FIG. 4 is a front view of the apparatus of FIG. 2.
Figure 5:
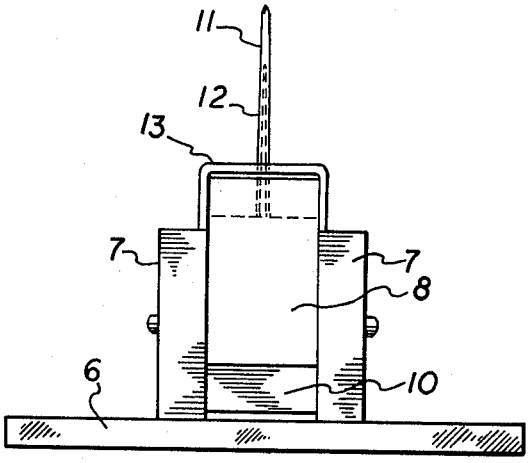
FIG. 5 is a back view of the apparatus of FIG. 2.
Figure 6:
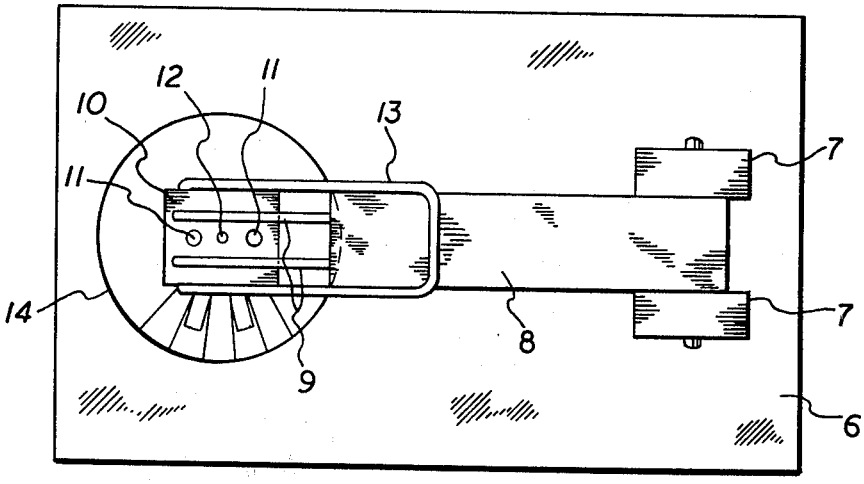
FIG. 6 is a top view of the apparatus of FIG. 2.
Figure 7:
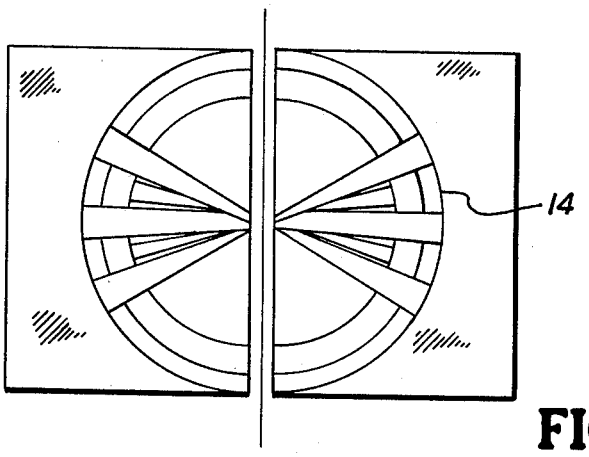
FIG. 7 depicts a template, containing the outline and radii of the loops of a bow, which may be used in conjunction with the apparatus of FIGS. 2–6.

Referring to FIGS. 1, 2 and 7, the apparatus 5 of the present invention for the production of the decorative product 1 of the present invention comprises a base 6, a support member 7 mounted to base 5, an arm 8 pivotably mounted to support member 7 having securing means 9 located at the end of arm 8 opposite from the pivotably mounted end, a workplate 10 mounted to base 6 having upwardly projecting guide means 11 and centering means 12 which define a work surface therebetween and which are adapted to engagingly receive material for decorative product 1, and means 13 for biasing arm 8 such that securing means 9 of arm 8 is biased against workplate 10. Furthermore, workplate 10 with guides means 11 and centering means 12 is positioned on base 5 in such a manner to receive securing means 9 of arm 8 thereon and therebetween.

In a preferred embodiment of the apparatus of the present invention, a template 14 illustrated in FIG. 7 containing the outline and radii of the loops of a bow of decorative product 1 is positioned on base 5 in juxtaposition to workplate 10 in order to facilitate the production of decorative product 1.

Except for means for biasing 13, the various components of apparatus 5 can be formed, molded or manufactured from virtually any material and may have virtually any shape, provided that such components meet the requirements of the invention as claimed herein. Suitable materials for the components of apparatus 5 include wood, plastic and metal. In a preferred embodiment, these components are molded from an inexpensive plastic such as polyethylene or polypropylene.

Means 13 for biasing arm 8 includes any mechanism which will bias securing means 9 against workplate 10. Suitable means include an elastomeric fastener as defined above, a spring, and a weighted portion of arm 8 adjacent to the end of arm 8 having securing means 9. Means 13 may be attached both to workplate 10 and arm 8 as illustrated in FIG. 2, to base 6 and arm 8, to support member 7 and arm8, to arm 8 alone or to any other components of apparatus 5 which will result in securing means 9 of arm 8 being biased against workplate 10. In a preferred embodiment, means 13 is an elastomeric band which is attached to arm 8 and workplate 10 in such a manner that securing means 9 of arm 8 is biased against workplate 10.

Support member 7 may be a single member or a plurality of members. In a preferred embodiment, support member 7 is a pair of spaced, parallel support members perpendicularly aligned to base 6 and attached to base 6 by any suitable connective means including adhesives, nails or screws. It is further possible that support member 7 may be an integral part of base 6 by forming support member 7 from the same piece of material from which base 6 is formed.

Arm 8 is mounted to support member 7 in any manner which permits reciprocation between support member 7 and workplate 10, preferably of a distance at least sufficient to withdraw securing means 9 from juxtaposition with guide means 11 and centering means 12. Preferably, reciprocation is provided by a channel contained in either the end of arm 8 pivotably mounted to support member 7, in support member 7 or in both arm 8 and support member 7, through which a shaft extends. The shaft is connected to both arm 8 and support member 7 and may be made from virtually any material, preferably wood, plastic or metal.

In a preferred embodiment, arm 8 is positioned in apparatus 5 in a plane parallel to base 6.

Securing means 9 may consist of a single member or a plurality of members which will secure the material from which the decorative product of the invention is made to workplate 10 during the production of the decorative product. In a preferred embodiment, securing means 9 is a pair of spaced, parallel cylindrical- or spike-shaped members projecting perpendicularly outward from the end of arm 8 opposite from the pivotably mounted end in a plane parallel to base 6.

Guide means 11 and centering means 12 may also be single members or a plurality of members which are positioned on workplate 10 in such a manner to define a work surface therebetween for the material from which the decorative product is made. Preferably, guide means 11 consists of a pair of spaced, parallel cylindrical- or spike-shaped members projecting vertically upward from the top of workplate 10 and centering means 12 consists of a single, pointed, cylindrical- or spike-shaped member situated between the pair of guide members 11 and projecting vertically upward from the top of workplate 10. In a further preferred embodiment, the pair of guide members 11 and centering member 12 are situated on workplate 10 in a perpendicular plane located equidistant between the pair of securing members 9.

A decorative product according to the present invention, preferably a bow and an elastomeric fastener attached thereto by connective means, may be made using the apparatus of the present invention by the following method. Referring to FIG. 2, arm 8 is reciprocated in a direction away from workplate 10 a sufficient distance to withdraw securing means 9 from juxtaposition with guide means 11 and centering means 12. An elastomeric fastener is then placed on workplate 10 between guide means 11 and centering means 12. Arm 8 with securing means 9 is then reciprocated back into its original position with securing means 9 biased against workplate 10. At this point, the elastomeric fastener is held to workplate 10 by securing means 9. The flexible material from which the bow is formed is next engaged on centering means 12 within guide means 11 and extended in a direction away from workplate 10 a predetermined distance at which point it is rotated 180° to form a loop. The predetermined distance may be randomly selected or may be preset by template 14 containing an outline of each loop of the bow. The free portion of the flexible material is next returned to workplate 10 wherein it is engaged on centering means 12 within guide means 11 after arm 8 with securing means 9 has been reciprocated in a direction away from workplate 10 as above. Arm 8 with securing means 9 is then reciprocated back into its original position with securing means 9 now securing the first loop of the bow and the elastomeric fastener to workplate 10. A second loop is next made in an identical manner as described above on the side of workplate 10 opposite to the side on which the first loop was made. This format is continued until a bow with the desired number of loops and the desired radii has been formed. At this point, the elastomeric fastener is extended around the bow to form a knot, arm 8 with securing means 9 is reciprocated in a direction away from workplate 10 and a formed bow with attached elastomeric fastener according to the invention is removed from apparatus 5. After removal from apparatus 5, the loops of the formed bow are further smoothed, if necessary or so desired, to form a more pleasingly, aesthetic bow.

Although the decorative device of the present invention can be manually made with the apparatus of the present invention, the apparatus and/or flexible material feeding mechanism can be automated. For instance, the reciprocation of arm 8 and the feeding of the flexible material from which the bow is formed could be accomplished by a pneumatic, hydraulic or electromagnetic system.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An apparatus for the production of a decorative product comprising (a) a base, (b) a support member mounted to said base, (c) an arm pivotably mounted to said support member adapted for reciprocation, said arm including securing means located at the end opposite from said pivotably mounted end, (d) workplate mounted to said base including upwardly projecting guide means and centering means which define a work surface therebetween, said guide means and centering means adapted to engagingly receive material for said decorative product and said workplate positioned to receive thereon said securing means of said arm, and (e) means for biasing said arm such that said securing means is biased against said workplate.

2. The apparatus of claim 1 wherein a template containing an outline of the decorative product is positioned on the base in juxtaposition to the workplate.

3. The apparatus of claim 1 wherein the support member is a pair of spaced, parallel support members perpendicularly aligned to the base.

4. The apparatus of claim 1 wherein the securing means is a pair of spaced, parallel members projecting perpendicularly outward from the end of the arm opposite from the pivotably mounted end in a plane parallel to the base.

5. The apparatus of claim 1 wherein the guide means is a pair of spaced, parallel members projecting vertically upward from the top of the workplate.

6. The apparatus of claim 5 wherein the centering means is a single member projecting vertically upward from the top of the workplate and is situated between the pair of guide members.

7. The apparatus of claim 1 wherein the guide means and the centering means are situated on the workplate in a perpendicular plane which passes through the center line of the securing means.

8. The apparatus of claim 1 wherein the means for biasing is selected from the group consisting of an elastomeric fastener, a spring and a weighted portion of the pivotably mounted arm.

* * * * *